US005231586A

United States Patent [19]

Shimizu

[11] Patent Number: 5,231,586

[45] Date of Patent: Jul. 27, 1993

[54] EMBROIDERY DATA PREPARING METHOD AND APPARATUS FOR EMBROIDERY MACHINE

[75] Inventor: Hideaki Shimizu, Nagoya, Japan

[73] Assignee: Brother Kogyo Kabushiki Kaisha, Nagoya, Japan

[21] Appl. No.: 665,482

[22] Filed: Mar. 5, 1991

[30] Foreign Application Priority Data

May 10, 1990 [JP] Japan ..... 2-120874

[51] Int. Cl.[5] ..... G06F 15/46; D05B 21/00

[52] U.S. Cl. ..... 364/470; 112/103; 112/121.12; 112/457

[58] Field of Search ..... 364/470; 112/2, 103, 112/457, 456, 121.12, 121.11, 445, 262.3, 266.1

[56] References Cited

U.S. PATENT DOCUMENTS

| | | | |
|---|---|---|---|
| 4,849,902 | 7/1989 | Yokoe et al. | 364/470 |
| 4,991,524 | 2/1991 | Ozaki | 364/470 |
| 5,054,408 | 10/1991 | Hayakawa | 364/470 |
| 5,181,176 | 1/1993 | Hayakawa | 112/121.12 |

*Primary Examiner*—Jerry Smith
*Assistant Examiner*—Thomas E. Brown
*Attorney, Agent, or Firm*—Oliff & Berridge

[57] ABSTRACT

Embroidery data for an embroidery machine is prepared by storing original outline data defining an embroidery area to be filled with stitches as a set of a plurality of closed outlines. The original outline data is modified into a single closed outline. Needle position relating data is then produced from the modified outline data to enable the embroidery area to be filled with stitches.

19 Claims, 7 Drawing Sheets

EMBROIDERY DATA PREPARING METHOD AND APPARATUS FOR EMBROIDERY MACHINE

BACKGROUND OF THE INVENTION

1. Field of the Invention

This invention relates to an embroidery data preparing method and apparatus which can prepare needle position relating data necessary to fill an embroidery area with stitches formed by an embroidery machine, and more particularly to an embroidery data preparing method and apparatus which can effectively prepare needle position relating data when an embroidery area is defined by a plurality of closed outlines.

2. Description of the Related Art

An embroidery data preparing apparatus is disclosed in pending U.S. Pat. No. 7,593,026, filed by the same assignee as the assignee of the present patent application, which includes an outline data memory for storing therein outline data defining a closed outline which in turn defines an embroidery area to be filled with stitches formed by an embroidery machine, and needle position relating data producing means for producing needle position relating data necessary to fill the embroidery area with stitches.

An embroidery area is not always defined by a single closed outline (hereinafter referred to only as "outline"). For example, an embroidery area is sometimes defined by a plurality of outlines as shown in FIG. 9. However, since the embroidery data preparing apparatus mentioned above is designed so that it may effectively prepare needle position relating data when the number of outlines that define an embroidery area is "1", a problem occurs in that, where the number of outlines that define an embroidery area is a plural number, desirable needle position relating data may not possibly be prepared for the embroidery area.

SUMMARY OF THE PRESENT INVENTION

To solve the above-mentioned problem, five steps described below are proposed by the inventors of the present application. At the first step, a plurality of imaginary areas are assumed which are individually defined by a plurality of outlines that define an embroidery area. At the second step, first needle position relating data is prepared which is necessary to fill a greatest outer side of one of the imaginary areas with stitches of a same color as the color of stitches to fill the embroidery area (such color is a color of stitches set for the embroidery area, and will be hereinafter referred to only as "set color"). At the third step, second needle position relating data is produced which is necessary to individually fill a plurality of inner imaginary areas present in the inside of the outer side imaginary area with stitches of the same color as the color of an object fabric for the embroidery (background color of the embroidery area). At the fourth step, embroidery is performed in accordance with the first needle position relating data. At the fifth step, embroidery is performed in accordance with the second needle position relating data after completion of the fourth step.

An exemplary embroidery process employing the above-described method will be described subsequently with reference to FIGS. 9 to 11. According to an embroidery area 610 shown in FIG. 9, an outer side imaginary area 600 and four inner side imaginary areas 602, 604, 606 and 608 in the inside of the outer side imaginary area 600 can be assumed. First, the outer side imaginary area 600 is filled with stitches of the same color as a set color as shown in FIG. 10. Then, from above the stitches, the inner side imaginary areas 602, 604, 606 and 608 are individually filled with stitches of the same color as a background color of the embroidery area 610 as illustrated in FIG. 11. Accordingly, those of the stitches of the same color as the set color which can be observed with the naked eye coincide with the embroidery area 610. Therefore, embroidery similar to such embroidery wherein only the embroidery area 610 is filled with stitches of the same color as the set color is realized.

However, where this method is employed, a different problem occurs in that, since embroidery is performed twice for each of the inner side imaginary areas 602, 604, 606 and 608, that is, for any portion which should not be observed with the naked eye, unsuitable swells are produced in the inner side imaginary areas 602, 604, 606 and 608. Where the number of outlines that define an embroidery area is a plural number in this manner, even if such special method of solution is employed, needle position relating data with which good embroidery stitches are to be realized may not be prepared.

It is an object of the present invention to provide an embroidery data preparing apparatus which can prepare, where the number of outlines that define an embroidery area is a plural number, needle position relating data desirable for the embroidery area. In order to attain the object, according to the present invention, there is provided an embroidery data preparing apparatus for an embroidery machine, which comprises an original outline data memory for storing therein original outline data defining an embroidery area to be filled with stitches formed by the embroidery machine as a set of a plurality of closed outlines, original outline data modifying means for modifying the original outline data into modified outline data that defines the embroidery area as a single closed outline, and needle position relating data producing means for producing needle position relating data necessary to fill the embroidery area with stitches based on the modified outline data.

It is to be noted that such needle position relating data is, for example, needle position data indicative of needle positions at which a sewing needle of the embroidery machine should penetrate an object fabric for the embroidery. By the way, the needle position relating data producing means may be of the type wherein an embroidery area is divided into a plurality of divisional areas and needle position relating data necessary to fill each of such divisional areas with stitches are produced. According to the needle position relating data producing means of the specific type, it is possible to produce needle position data as needle position relating data and also to produce, as needle position relating data, data that defines each divisional area and data that defines a density of stitches with which each divisional area is to be filled.

In the embroidery data preparing apparatus of the present invention, original outline data defining an embroidery area as a set of a plurality of outlines is changed by the original outline data modifying means into modified outline data defining the embroidery area as a single outline. Needle position relating data is produced from such modified outline data by the needle position relating data producing means. In other words, a single outline which is equivalent to the plurality of outlines is assumed, and needle position relating data is produced using the single outline.

The original outline data modifying means may be comprised, for example, of original outline selecting means for selecting two suitable original outlines among the plurality of original outlines, outline coupling means for coupling the two original outlines thus selected to obtain a single modified outline, and controlling means for causing the outline selecting means and the outline coupling means to operate repetitively until a condition is reached wherein the embroidery area is defined by a single modified outline.

In this manner, in accordance with the embroidery data preparing apparatus of the present invention, when the number of original outlines that define an embroidery area is a plural number, needle position relating data is produced using a single modified outline which is equivalent to the original outlines. Accordingly, the embroidery data preparing apparatus of the present invention is advantageous in that it can prepare needle position relating data desirable for an embroidery area.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 1:
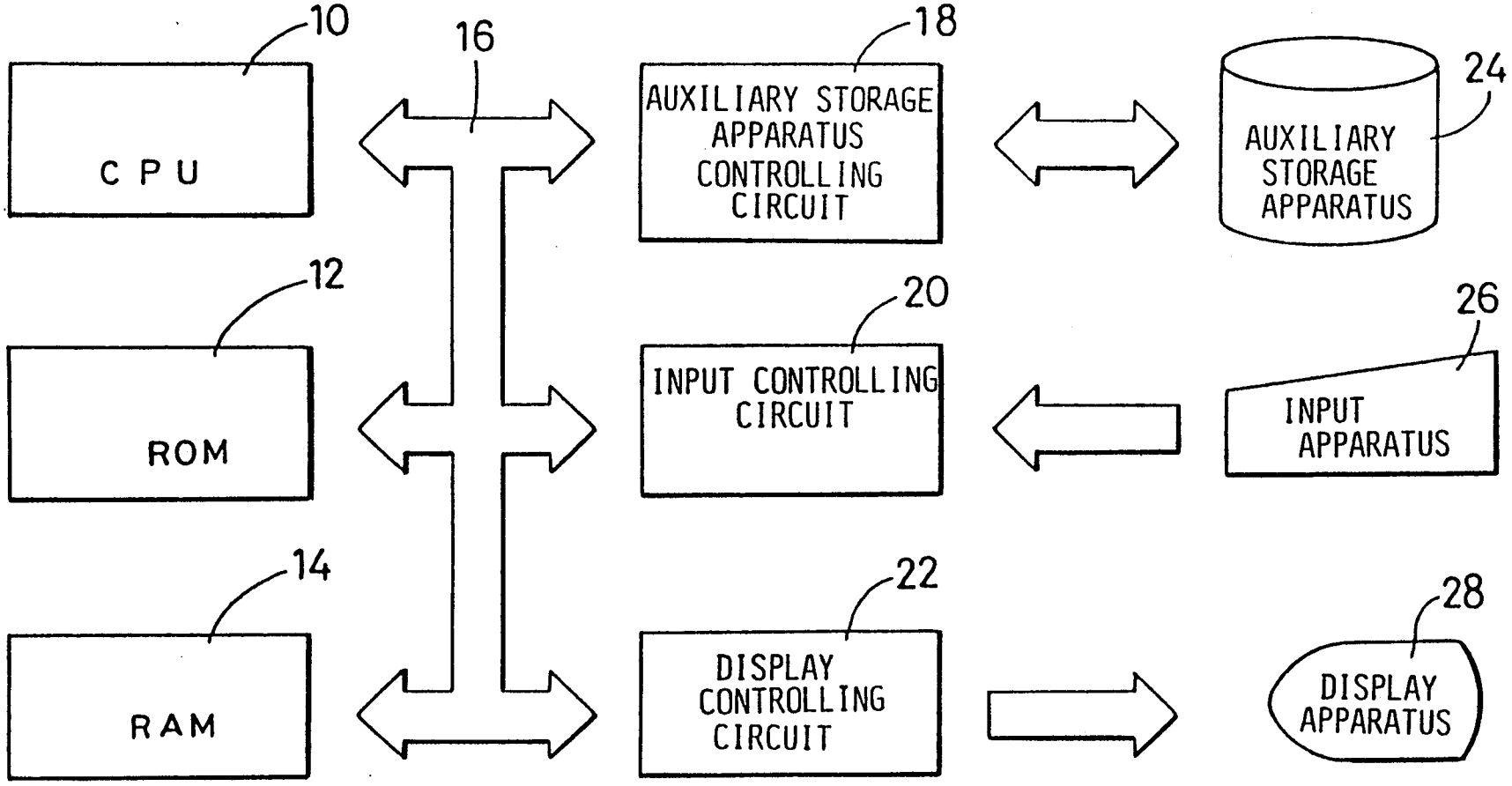
FIG. 1 is a block diagram showing an embroidery data preparing apparatus of an embodiment of the present invention.
Figure 2:
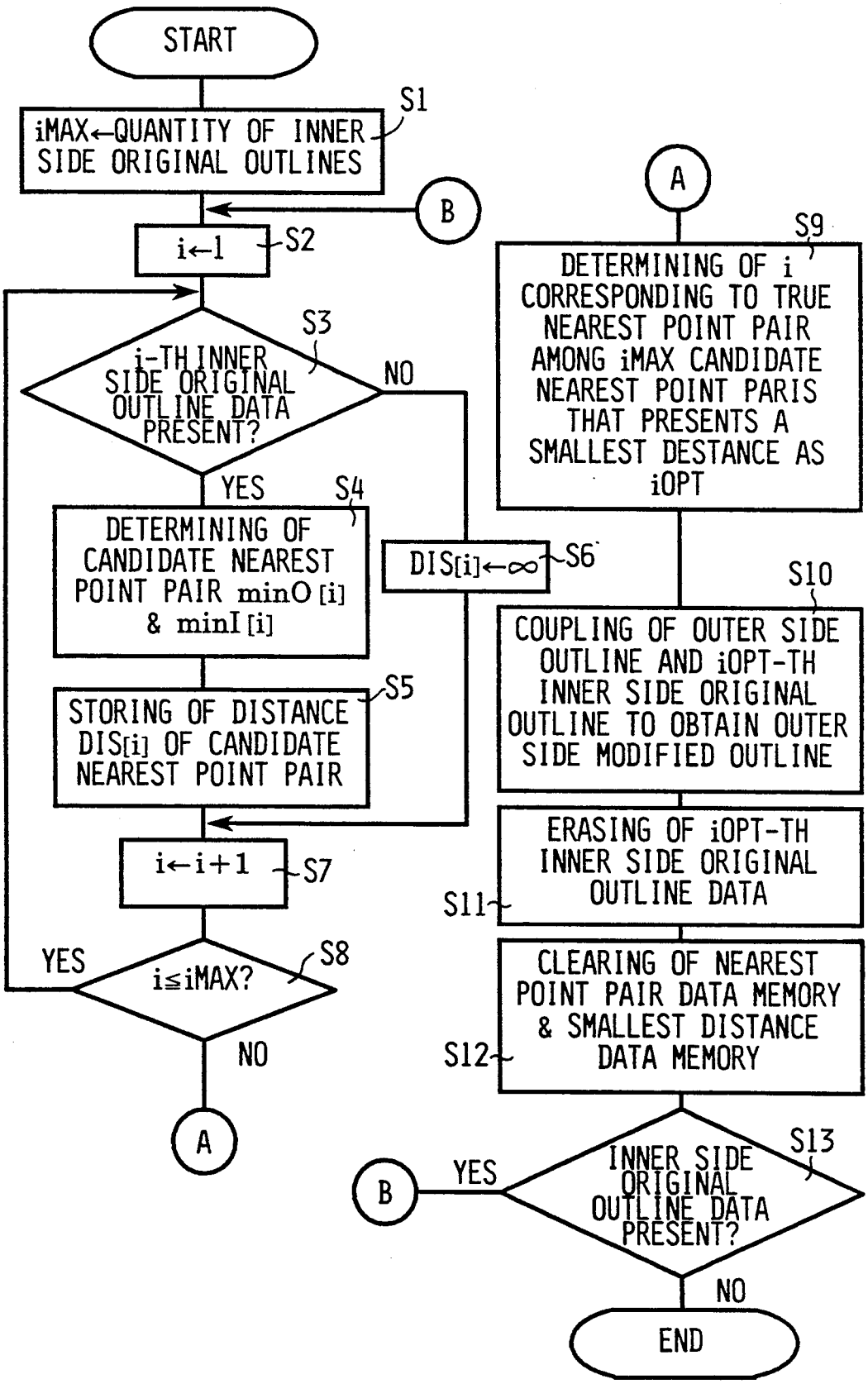
FIG. 2 is a flow chart showing an outline coupling program to be executed by the embroidery data processing apparatus.
Figure 3:
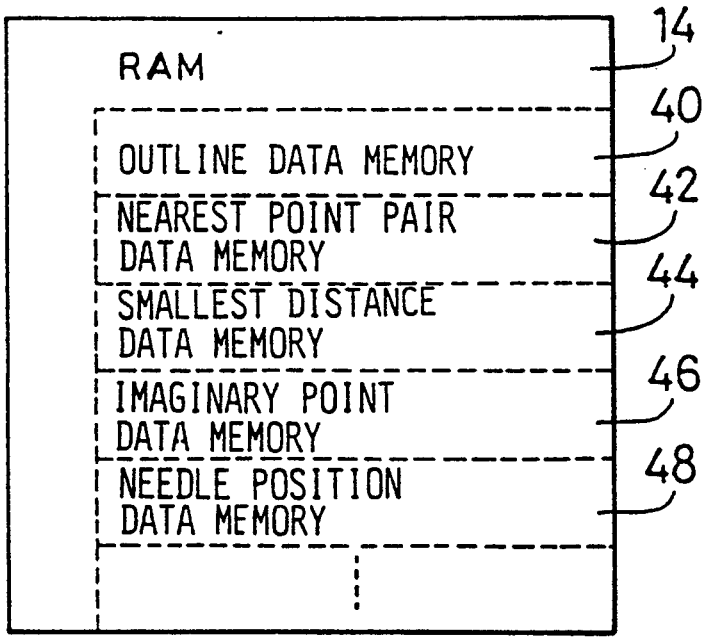
FIG. 3 is a diagrammatic representation illustrating construction of a RAM shown in FIG. 1.

Referring now to the drawings, and more particularly to FIG. 1 thereof, there is shown, in block diagram, an embroidery data preparing apparatus of an embodiment of the present invention. A ROM (read-only memory) 12 and a RAM (random access memory) 14 are connected to a CPU (central processing unit) 10 by way of a bus 16. An auxiliary storage apparatus 24, an input apparatus 26 and a display apparatus 28 are also connected to the CPU 10 by way of an auxiliary storage apparatus controlling circuit 18, an input controlling circuit 20 and a display controlling circuit 22, respectively. The ROM 12 has various control programs stored therein including an outline coupling program illustrated in the flow chart of FIG. 2 and a needle position data producing program for producing needle position data necessary to fill an embroidery area with stitches formed by an embroidery machine. The CPU 10 reads out, in accordance with the control programs stored in the ROM 12, data from the RAM 14 or auxiliary storage apparatus 24 and executes processing of embroidery data. Detailed description of the needle position data producing program mentioned above is omitted herein because a program similar to the program disclosed in aforementioned U.S. patent application Ser. No. 07/593,026 can be used as such needle position data producing program. U.S. Pat. No. 07,593,026 is incorporated by reference in the present patent application. Referring to FIG. 3, the RAM 14 includes an outline data memory 40, a nearest point pair data memory 42, a smallest distance data memory 44, an imaginary point data memory 46, a needle position data memory 48 which will be hereinafter described etc.

A plurality of embroidery areas to be filled with stitches formed by an embroidery machine are each defined by one or more closed original outlines (hereinafter referred to only as "original outline"). An original outline for defining each embroidery area is stored in advance as original outline data in the auxiliary storage apparatus 24. Each original outline is a closed polygonal line represented by a set of a plurality of points. Each original outline data is a set of point data representative of coordinates (X-Y coordinates set for an embroidery machine) of points. A set of point data constituting original outline data is stored in the same order as the order in which points represented by the individual point data are arranged in the clockwise direction on an original outline.

Figure 4:
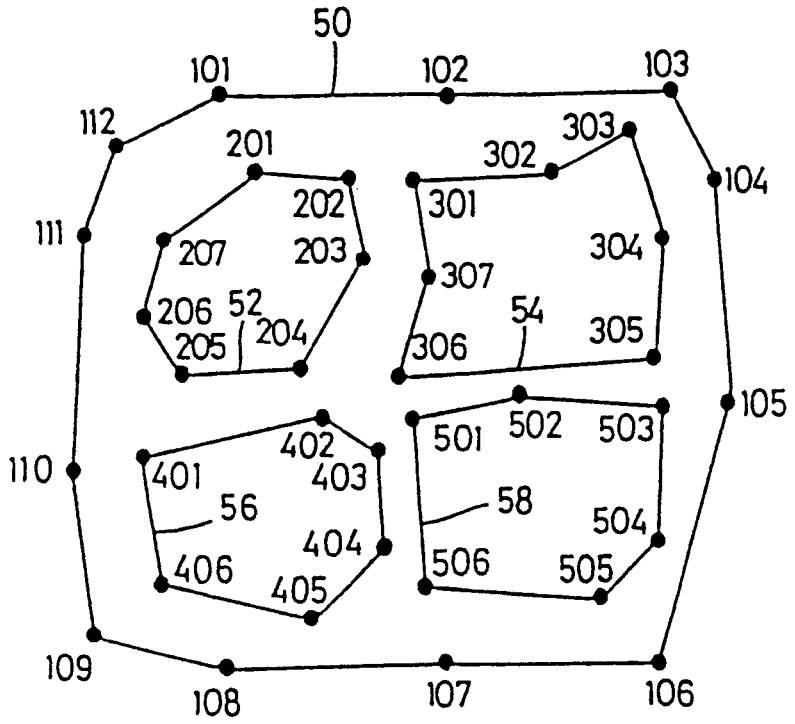
FIGS. 4 to 8 are diagrammatic representations showing an embroidery area for which the outline coupling program is used.

Description will be given subsequently of a case wherein an embroidery area is defined by, for example, as shown in FIG. 4, an outer side original outline 50 and four inner side outlines 52, 54, 56 and 58 contained in the inside of the outer side original outline 50. Each of the outlines 50, 52, 54, 56 and 58 is stored in the auxiliary storage apparatus 24 as original outline data which is represented as a set of the following point data. In particular, the original outline data of the outer side original outline 50 is represented as a set of point data of points 101 (start point), 102, . . . and 112 (end point). The original outline data of the first inner side outline 52 is represented as a set of point data of points 201 (start point), 202, . . . and 207 (end point). The original outline data of the second inner side original outline 54 is represented as a set of point data of points 301 (start point), 302, . . . and 307 (end point). The original outline data of the third inner side original outline 56 is represented as a set of point data of points 401 (start point), 402, . . . and 406 (end point). The original outline data of the fourth inner side original outline 58 is represented as a set of point data of points 501 (start point), 502, . . . and 506 (end point).

The input apparatus 26 includes a mouse and a keyboard including a large number of key switches adapted to be operated by an operator for controlling operation of the CPU 10. The display apparatus 28 includes a CRT display for displaying thereon an embroidery area read from the auxiliary storage apparatus 24.

Subsequently, description will be provided of operation of the embroidery data preparing apparatus of the present embodiment.

First, the CPU 10 judges whether or not a coupling instruction to couple a plurality of original outlines into a single modified outline has been input by operation of the keyboard of the input apparatus 26. If the CPU 10 judges that such coupling instruction has been input, it then reads out original outline data for all of a plurality of embroidery areas stored in the auxiliary storage apparatus 24 from the auxiliary storage apparatus 24 and stores the thus read original outline data into the outline data memory 40 of the RAM 14. Subsequently, the CPU 10 causes the display apparatus 28 to display all of the plurality of embroidery areas on the screen of the CRT display in accordance with such original outline data. An operator will thus select, in accordance with results of such display, one of the plurality of embroidery areas for which the operator wants to subsequently effect outline coupling by way of the mouse of the input apparatus 26. The CPU 10 thus executes the outline coupling program illustrated in the flow chart of FIG. 2 for the embroidery area selected by such operation of the mouse (such embroidery area will be hereinafter referred to as "current embroidery area").

Outline coupling according to the outline coupling program will now be described.

First, of a plurality of points on a single outer side original outline which belong to a current embroidery area and another plurality of points on one or more inner side original outlines, two points which are positioned nearest to each other (such points will be hereinafter referred to as "true nearest point pair") are determined. Subsequently, the outer side original outline and one of the inner side original outlines to which one of the points of the true nearest point pair (such inner side original outline will be hereinafter referred to as "current inner side original outline") are coupled to each other. More particularly, the outer side original outline is modified into an outer side modified outline wherein the current inner side original outline is merged in the outer side original outline, and the current inner side original outline is extinguished. After such merging and extinction of the inner side original outline, original outline data of the outer side original outline is modified, on the outline data memory 40 of the RAM 14, into modified outline data of the outer side modified outline, and original outline data of the current inner side original outline is erased. After the outer side original outline and the current inner side original outline have been coupled to each other in this manner, it is judged whether or not there still remains an inner side original outline for which original outline data has not yet been erased. When it is judged that there remains an inner side original outline for which original outline data has not yet been erased, subsequent outline coupling is performed for the outer side modified outline determined in the current outline coupling and the inner side original outline for which original outline data has not yet been erased.

Such outline coupling as described so far is repeated until original outline data is erased for all of the inner side original outlines. As a result, the outer side original outline and the inner side original outline or outlines are coupled to each other to make a single modified outline.

Such outline coupling will be described in detail with reference to the flow chart of FIG. 2.

The CPU 10 executes processing at each step described below in accordance with the outline coupling program. First, at step S1, a quantity or number iMAX of inner side original outlines which belong to a current embroidery area is determined from original outline data for the current embroidery area. Then, at step S2, the value of an order number i of an inner side original outline is set to "1". Subsequently, at step S3, it is judged whether or not i-th inner side original outline data is present in the outline data memory 40 of the RAM 14. In other words, it is judged whether or not original outline data for the i-th inner side original outline has not yet been erased.

When it is judged at step S3 that such i-th inner side original outline data is present, the control sequence advances to step S4 at which, for all of a plurality of point pairs which are combinations of different points on the outer side outline of the current embroidery area with different points on the i-th inner side original outline, a distance between two points belonging to each point pair (between a point on the outer side outline and another point on the i-th inner side original outline) is determined. It is to be noted that the outer side outline may be either an outer side original outline or an outer side modified outline, and, in either case, it will be hereinafter referred to merely as an outer side outline. One of the point pairs which exhibits a smallest distance is then determined as a candidate for the true nearest point pair (hereinafter referred to only as a "candidate nearest point pair"). Further, one of the two points belonging to the candidate nearest point pair which is on the outer side outline and the other point which is on the i-th inner side original outline are stored as minO[i] and minI[i], respectively, into the nearest point pair data memory 42 of the RAM 14. Subsequently, at step S5, the distance of the candidate nearest point pair of the outer side outline and the i-th inner side original outline is stored as DIS[i] into the smallest distance data memory 44 of the RAM 14.

To the contrary, when it is judged at step S3 that i-th inner side original outline data is not present, the control sequence now advances to step S6 at which data 15 representing that the distance is infinitely great is stored as DIS[i] into the smallest distance data memory 44. In either case, the sequence subsequently advances to step S7 at which the current value of i is incremented by "1" to determine a next value of i. Then at step S8, it is determined whether or not the next value of i is equal to or smaller than the quantity iMAX of the inner side original outlines. If the result of such judgment is "YES", then the control sequence returns to step S3.

If the result of judgment at step S8 changes to "NO" after the steps S3 to S8 are executed for all of the first to iMAX-th inner side original outlines, then the control sequence now advances to step S9. At step S9, one of the iMAX candidate nearest point pairs which exhibits a minimum distance is determined as a true nearest point pair. One of the inner side original outlines which has either one of the two points belonging to such true nearest point pair is determined as a proper inner side original outline which is to be merged into the current outer side outline. Then, the order number iOPT of the proper inner side original outline is determined as an order number i of the inner side original line which has either one of the two points belonging to the true nearest point pair. For example, in the case of the embroidery area shown in FIG. 4, a combination of the point 103 on the outer side original outline 50 and the point 303 on the second inner side original outline 54 is determined as a true nearest point pair.

Afterwards, at step S10, an outer side modified outline wherein the outer side outline and the iOPT-th inner side original outline, which is the proper inner side original outline, are coupled to each other is determined. Such modified outline data of the outer side modified outline is stored into the outline data memory 40 of the RAM 14 in place of the outline data of the outer side outline which has been currently stored therein so far.

Such outer side modified outline data represents a plurality of points arranged in the order of passage when passed, while one traces the outer side outline in the clockwise direction from the start point of the outer side outline, and then, after an outer side coupling point stored as minO[iOPT] is reached, it advances from the outer side coupling point to an inner side coupling point stored as minI[iOPT], whereafter it traces the iOPT-th inner side original outline in the counterclockwise direction, and after the inner side coupling point is reached, it traces the outer side outline in the clockwise direction to the end point of the outer side outline. As for the example shown in FIG. 4, outer side modified outline data represents a plurality of points arranged in the order of passage when passed while one traces the outer side original outline 50 in the clockwise direction from the start point 101 of the outer side original outline 50, and after the outer side coupling point 103 is reached, it advances to the inner side coupling point 303, whereafter it traces the second inner side original outline 54 in the counterclockwise direction. After the inner side coupling point 303 is reached, it advances to the outer side coupling point 103 and then traces the outer side original outline 50 in the clockwise direction to the end point 112 of the outer side original outline 50.

It is to be noted that, at step S10, a going side coupling line along which one advances from the outer side outline to the iOPT-th inner side original outline (in the case of the example of FIG. 4, a going side coupling line 70 shown in FIG. 5) and a returning side coupling line along which one returns from the iOPT-th inner side original outline to the outer side outline (in the example of FIG. 4, a returning side coupling line 72 shown in FIG. 5) are temporarily differentiated from each other. The reason why such going side coupling line and returning side coupling line are temporarily differentiated from each other will be described subsequently. After execution of the outline coupling program is completed and modified outline data for a single modified outline is produced, such needle position data producing program as mentioned hereinabove is executed. In execution of the needle position data producing program, suitable ones of a plurality of points on the modified outline are selected as dividing points. Then, the embroidery area is divided into a plurality of divisional areas with straight lines passing the dividing points. Finally, needle position data for filling each of the divisional areas with stitches is produced. Accordingly, if the going side coupling line and the returning side coupling line coincide with each other, then there exists data of two points indicative of the same coordinates when the embroidery area is divided into a plurality of divisional areas. If the needle position data producing program is executed in such a situation, then since the needle position data producing program is not designed so as to operate by taking into consideration the fact that two of a plurality of sides defining the embroidery area between which each of such two points as described above is included are different between the two points, there is the possibility that unsuitable dividing points may be selected and the embroidery area may be divided into unsuitable divisional areas. Due to such circumstances, the outer side coupling point and the inner side coupling point are differentiated from each other between the going side coupling line and the returning side coupling line.

Figure 5:
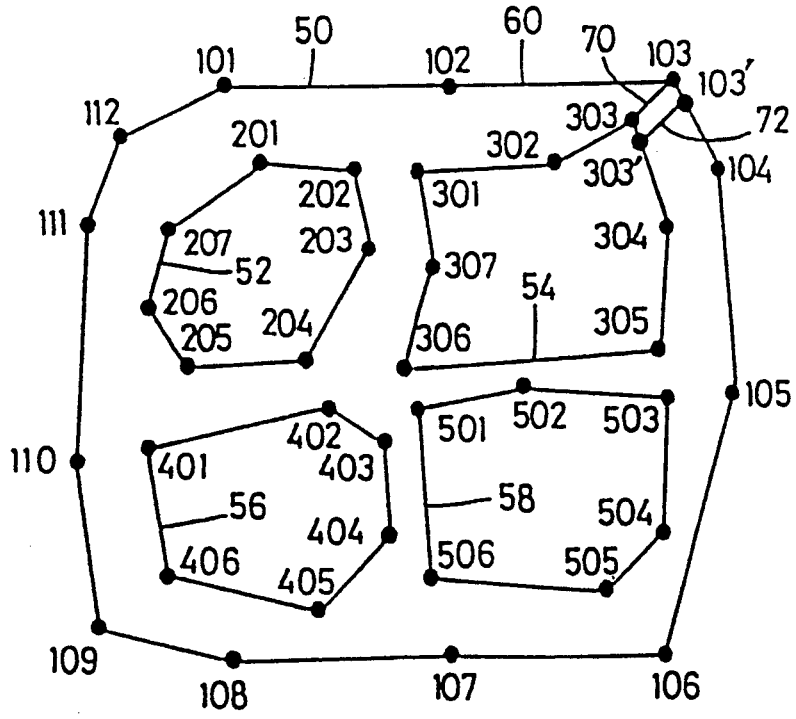

A going side coupling line is defined by an outer side coupling point (hereinafter referred to as a real outer side coupling point in connection with an imaginary outer side coupling point which will be hereinafter described:) and a similar real inner side coupling point. On the other hand, a returning side coupling line is defined by an imaginary outer side coupling point set in the proximity of a real outer side coupling point and an imaginary inner side coupling point set in the proximity of a real inner side coupling point. Such imaginary outer side coupling point is a point which is in the proximity of a real inner side coupling point and is positioned on one of two sides of an outer side outline including a real outer side coupling point which is positioned on the clockwise side of a real inner side coupling point. For example, in the case of the example of FIG. 4, the points 103 and 303 are determined as a real outer side coupling point and a real inner side coupling point, respectively, of the going side coupling line 70 as shown in FIG. 5. On the other hand, points 103' and 303' are determined as an imaginary outer side coupling point and an imaginary inner side coupling point, respectively, of the returning side coupling line 72.

Further, at step S10, such imaginary outer side coupling point and imaginary inner side coupling point are stored into the imaginary point data memory 48 of the RAM 14 in connection with the real outer side coupling point and real inner side coupling point, respectively. Thus, in execution of the needle position data producing program described hereinabove which is executed after completion of execution of the outline coupling program, the embroidery area is divided into a plurality of divisional areas based on the single modified outline. The imaginary points defining those divisional areas are then restored to real points, and needle position data for filling each divisional area with stitches is produced without employing any imaginary point.

At step S11, the iOPT-th inner side original outline data is then erased on the outline data memory 40. Subsequently, at step S12, the nearest point pair data memory 44 and smallest distance data memory 46 of the RAM 14 are cleared in preparation for subsequent execution of the steps S1 to S8. Finally at step S13, it is judged whether or not inner side original outline data remains in the outline data memory 40. When the judgement at step S13 is "YES", the control sequence returns to step S2, but, when the judgment is "NO", the current execution of the outline coupling program comes to an end.

A manner in which the outline coupling program is executed will be described with the embroidery area shown in FIG. 4, that is, the embroidery area defined by the outer side original outline 50 and first to fourth inner side original outlines 52, 54, 56 and 58, respectively.

After execution of the outline coupling program is started, the point 103 on the outer side original outline 50 and the point 303 on the second inner side original outline 54 are selected as a true nearest point pair as seen in FIG. 5 by initial execution of the steps S2 to S13.In order to couple the outer side original outline 50 and the second inner side original outline 54 to each other, the outer side original outline 50 is then changed into an outer side modified outline 60 defined by the points 101, 102, 103, 303, 302, 301, 307, 306, 305, 304, 303', 103', 104, 105, . . . and 112, and then the second inner side original outline 54 is extinguished.

Figure 6:
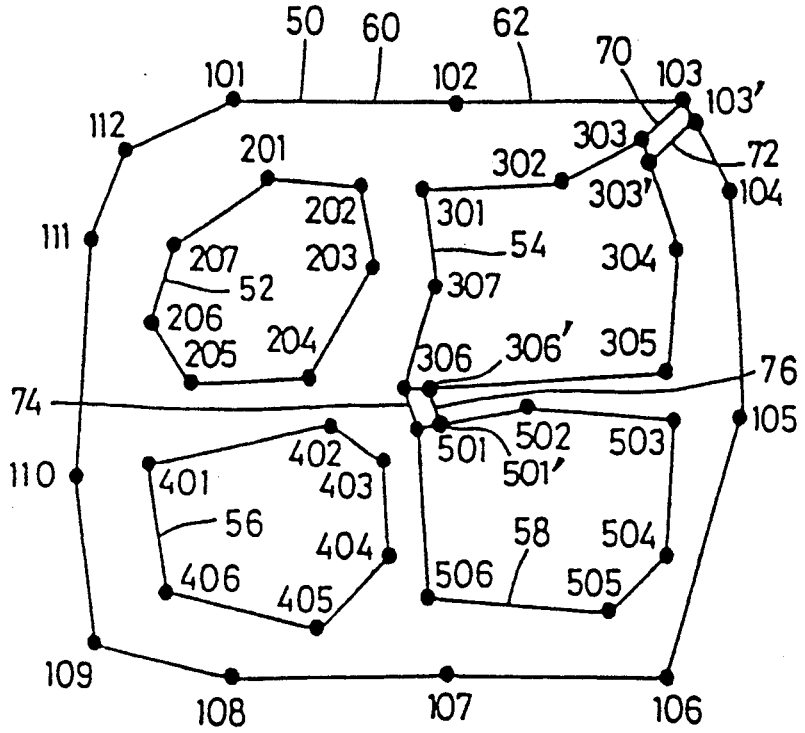

Then, by execution of the steps S2 to S13 for the second time, the point 306 on the outer side modified outline 60 and the point 501 on the fourth inner side original outline 58 are selected as a true nearest point pair as seen in FIG. 6. Afterwards, in order to couple the outer side modified outline 60 and the fourth inner side original outline 58 to each other, the outer side modified outline 60 is changed into another outer side modified outline 62 defined by the points 101, 102, 103, 303, . . . , 306, 501, 506, 505, . . . , 502, 501', 306', 305, . . . 303', 103', 104, . . . 112, and then the fourth inner side original outline 58 is extinguished. In short, a current going side coupling line 74 is defined by the real outer side coupling point 306 and the real inner side coupling point 501. Meanwhile, a current returning side coupling line 76 is defined by the imaginary outer side coupling point 306, and the imaginary inner side coupling point 501'.

Figure 7:
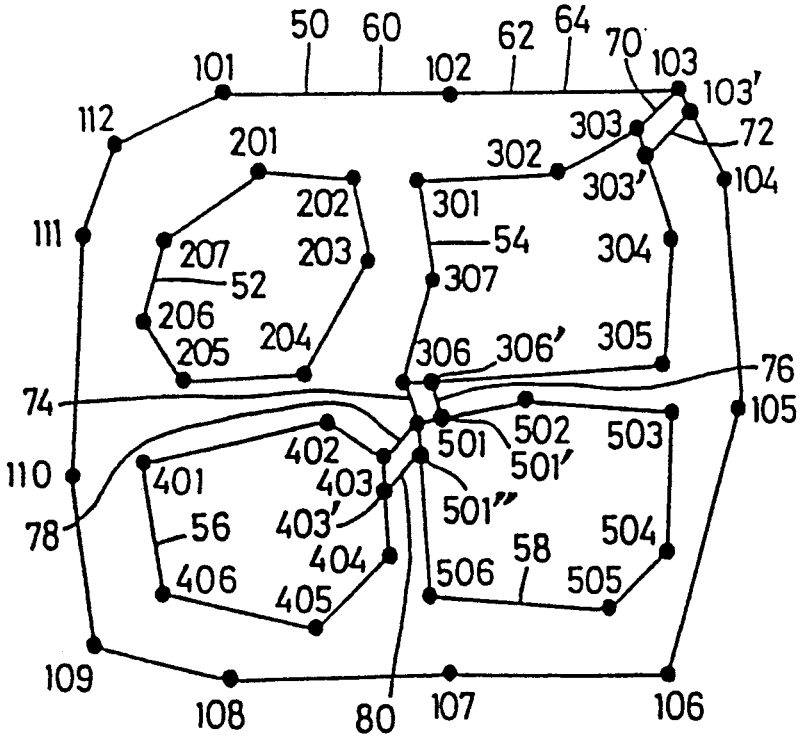
Figure 8:
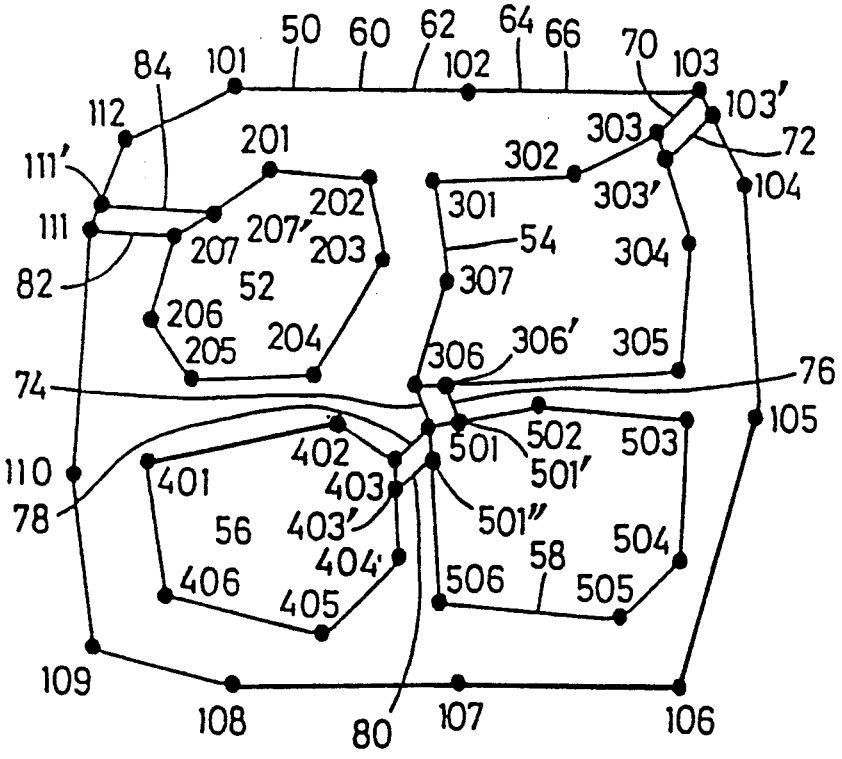
Figure 9:
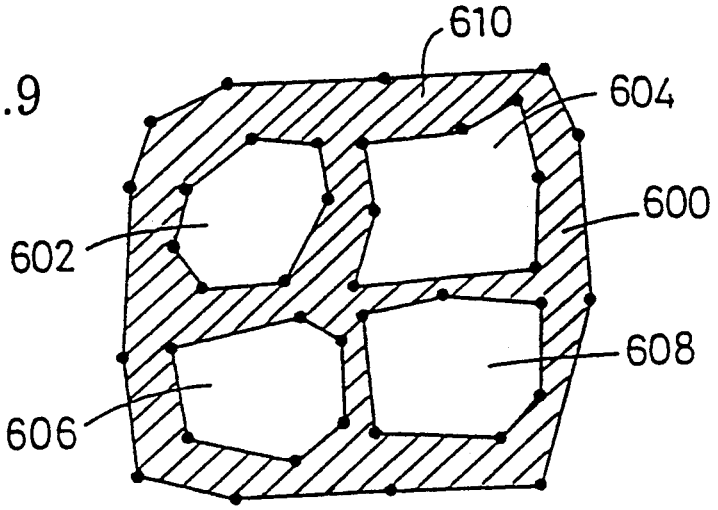
FIGS. 9 to 11 are diagrammatic representations illustrating operation of an embroidery data preparing apparatus according to a related invention.
Figure 10:
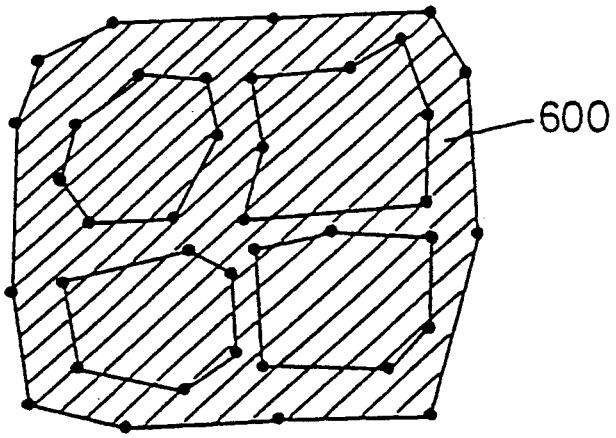
Figure 11:
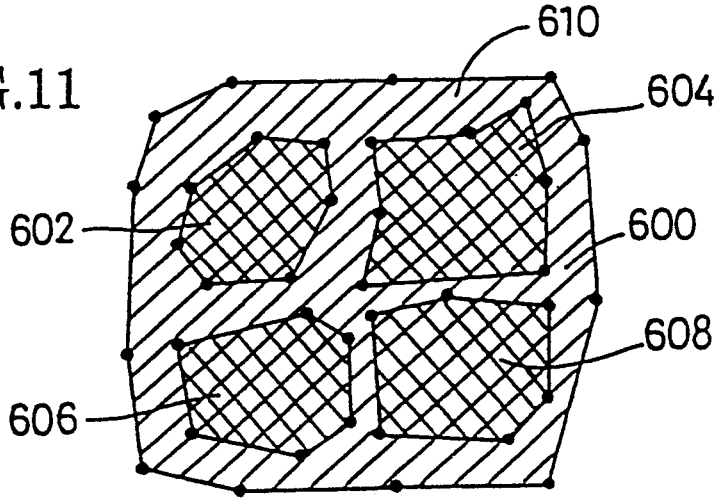

Further, by execution of the steps S2 to S13 for the third time, the point 501 on the outer side modified outline 62 and the point 403 on the third inner side original outline 56 are selected as a true nearest point pair as seen in FIG. 7. In order to couple the outer side modified outline 62 and the third inner side original outline 56 to each other, the outer side modified outline 62 is then changed into a further outer side modified outline 64 defined by the points 101, 102, 103, 303, . . . 306, 501, 403, 402, 401, 406, 405, 404, 403', 501'', 506, . . . , 501', 306', 305, . . . 303', 103', 104, . . . and 112, and then the third inner side original outline 56 is extinguished. In short, a current going side coupling line 78 is defined by the real outer side coupling point 501 and the real inner side coupling point 403. Meanwhile, a current returning side coupling line 80 is defined by the imaginary outer side coupling point 501'' and the imaginary inner side coupling point 403'.

Further, by execution of the steps S2 to S13 for the fourth time, the point 111 on the outer side modified outline 64 and the point 207 on the first inner side original outline 52 are selected as a true nearest point pair. Afterwards, in order to couple the outer side modified outline 64 and the first inner side original outline 52 to each other, the outer side modified outline 64 is changed into a still further outer side modified outline 66 defined by the points 101, 102, 103, 303, . . . , 306, 501, 403, . . . , 403', 501'', . . . 501', 306', . . . , 303', 103', 104, . . . , 111, 207, 206, . . . , 201, 207', 111' and 112, and then the first inner side original outline 52 is then extinguished. In short, a current going side coupling line 82 is defined by the real outer side coupling point 111 and the real inner side coupling point 207. Meanwhile, a current returning side coupling line 84 is defined by the imaginary outer side coupling point 111' and the imaginary inner side coupling point 207'. By such execution of the steps S2 to S13 by four times as described above, the five original outlines 50 to 58 are changed into the single modified outline 66. Then, the result of judgment at step S13 changes into "NO", and the execution of the outline coupling program comes to an end.

After the outline coupling is executed once in such a manner as described above, the CPU 10 judges whether or not an instruction to produce needle position data for the current embroidery area has been issued by operation of the keyboard of the input apparatus 26. If the CPU 10 judges that an instruction to produce needle position data has been issued, it then executes the needle position data producing program described above. In such execution of the needle position data producing program, the embroidery area is first divided into a plurality of divisional areas. Then, processing of restoring the imaginary points into the real points is executed in accordance with the imaginary point data stored in the imaginary point data memory 48 of the RAM 14. Finally, needle position data are produced for each of the divisional areas, and the needle position data thus produced are stored into the needle position data memory 48 of the RAM 14.

As apparent from the foregoing description, in the present embodiment, the outline data memory 40 of the RAM 14 functions as an original outline data memory for storing original outline data therein and also as a modified outline data memory for storing modified outline data therein.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An embroidery data preparing apparatus for an embroidery machine, comprising:

an original outline data memory for storing therein original outline data defining a predetermined embroidery area to be filled with stitches formed by said embroidery machine as a set of a plurality of closed outlines;

original outline data modifying means for modifying the original outline data into modified outline data defining the predetermined embroidery area as a single closed outline whereby the plurality of closed outlines are changed into the single closed outline with respect to the predetermined embroidery area; and needle position relating data producing means for producing needle position relating data necessary to fill the predetermined embroidery area with stitches based on the modified data.

2. The embroidery data preparing apparatus according to claim 1, wherein said needle position relating data producing means includes dividing means for dividing the embroidery area defined by the modified outline data into a plurality of divisional areas, and needle position data producing means for producing needle position data necessary to fill each of the divisional areas formed by said dividing means with stitches, said needle position data being indicative of positions at which a sewing needle of said embroidery machine is to penetrate an object fabric for the embroidery.

3. The embroidery data preparing apparatus according to claim 1, wherein said original outline data modifying means includes original outline selecting means for selecting two suitable original outlines from among the plurality of original outlines;

outline coupling means for coupling the two original outlines selected by said original outline selecting means to obtain a single modified outline; and controlling means for causing said outline selecting means and said outline coupling means to operate repetitively until a condition is reached wherein the embroidery area is defined by a single modified outline.

4. The embroidery data preparing apparatus according to claim 3, wherein said original outline selecting means selects two original outlines which are positioned nearest to each other among the plurality of original outlines.

5. The embroidery data preparing apparatus according to claim 1, wherein said original outline data memory stores inner side original outline data defining at least one inner side original outline and outer side original outline data defining an outer side original outline, said at least one inner side original outline being located within the outer side original outline, said outer side original outline defining an outer boundary of said embroidery area and said at least one inner side original outline defining at least one inner boundary of said embroidery area.

6. The embroidery data preparing apparatus according to claim 5, wherein said original outline data modifying means successively merges selected inner side original outline data into outer side outline data to provide said modified outline data.

7. The embroidery data preparing apparatus according to claim 6, wherein said original outline data modifying means removes stored inner side original outline data when said stored inner side original outline data has been merged into the outer side outline data.

8. The embroidery data preparing apparatus according to claim 6, wherein said original outline data modifying means operates until all inner side original outline data has been merged into the outer side outline data.

9. The embroidery data preparing apparatus according to claim 6, wherein said needle position relating data producing means produces needle position relating data when all inner side original outline data has been merged into the outer side outline data.

10. A method of preparing embroidery data for an embroidery machine, comprising:

storing original outline data defining a predetermined embroidery area to be filled with stitches formed by the embroidery machine as a set of a plurality of closed outlines;

modifying the original outline data to define the predetermined embroidery area as a single closed outline whereby the plurality of closed outlines are changed into the single closed outline with respect to the predetermined embroidery area; and producing needle position relating data necessary to fill the predetermined embroidery area with stitches based on the modified outline data.

11. The method of preparing embroidery data according to claim 10, including dividing the embroidery area defined by the modified outline data into a plurality of divisional areas and producing needle position data necessary to fill each of the divisional areas with stitches, said needle position data being indicative of positions at which a sewing needle of said embroidery machine is to penetrate an object fabric for the embroidery.

12. The method of preparing embroidery data according to claim 10, including selecting two suitable original outlines from among the plurality of closed outlines, coupling the two suitable original outlines to obtain a single modified outline and repetitively selecting two suitable original outlines and coupling the outlines until the embroidery area is defined by a single modified outline.

13. The method of preparing embroidery data according to claim 12, wherein said selecting includes selecting two suitable original outlines which are positioned nearest to each other among the plurality of closed outlines.

14. The method of preparing embroidery data according to claim 10, including storing inner side original outline data defining at least one inner side original outline and outer side original outline data defining an outer side original outline, the at least one inner side original outline being located within the outer side original outline, the outer side original outline defining an outer boundary of said embroidery area and the at least one inner signal original outline defining at least one inner boundary of said embroidery area.

15. The method of preparing embroidery data according to claim 14, including successively merging selected inner side original outline data into outer side outline data to provide said modified outline data.

16. The method of preparing embroidery data according to claim 15, including removing stored inner side original outline data when said stored inner side original outline data has been merged into the outer side outline data.

17. The method of preparing embroidery data according to claim 15, including modifying said original outline data until all inner side original outline data has been merged into the outer side outline data.

18. The method of preparing embroidery data according to claim 15, including producing needle position relating data when all inner side original outline data has been merged into the outer side outline data.

19. An embroidery data preparing apparatus for an embroidery machine, comprising:

original outline storing means for storing inner side original outline data defining at least one inner side original outline and outer side original outline data defining an outer side original outline, said at least one inner side original, outline being located within the outer side original outline, said outer side original outline defining an outer boundary of an embroidery area and said at least one inner side original outline defining at least one inner boundary of said embroidery area;

original outline merging means for successively merging selected inner side original outline data into outer side outline data to provide modified outline data; and needle position relating data producing means for producing needle position relating data when all inner side original outline data has been merged into the outer side outline data.

* * * * *